US008310322B2

(12) United States Patent
Tomimbang

(10) Patent No.: US 8,310,322 B2
(45) Date of Patent: Nov. 13, 2012

(54) SOLENOID ACTUATOR WITH AN INTEGRATED MECHANICAL LOCKING AND UNLOCKING FIXTURE

(76) Inventor: Wendell E. Tomimbang, Kissimmee, FL (US)

( * ) Notice: Subject to any disclaimer, the term of this patent is extended or adjusted under 35 U.S.C. 154(b) by 261 days.

(21) Appl. No.: 12/758,790

(22) Filed: Apr. 12, 2010

(65) Prior Publication Data

US 2011/0148552 A1 Jun. 23, 2011

Related U.S. Application Data

(63) Continuation-in-part of application No. 12/642,737, filed on Dec. 18, 2009.

(51) Int. Cl.

| | |
|---|---|
| ***H01H 83/00*** | (2006.01) |
| ***H01H 73/02*** | (2006.01) |
| ***H01H 75/00*** | (2006.01) |
| ***H01H 77/00*** | (2006.01) |

(52) U.S. Cl. ..... 335/21; 200/11 TC; 200/17 R

(58) Field of Classification Search ..... 335/21, 335/22, 26, 176, 185, 186; 200/11 TC, 1 R, 200/17 R, 18, 50 C, 50 A, 323, 324, 327, 200/400

See application file for complete search history.

(56) References Cited

U.S. PATENT DOCUMENTS

| | | | | |
|---|---|---|---|---|
| 6,693,248 | B1 * | 2/2004 | Schultz | 200/11 TC |
| 7,541,555 | B2 * | 6/2009 | Chang | 200/524 |

* cited by examiner

*Primary Examiner* — Bernard Rojas

(74) *Attorney, Agent, or Firm* — The Miller Law Offices PLC; Steven J Miller, Esq.

(57) ABSTRACT

Electric Solenoid Actuators are used in a wide range of industries that require the combination of electrical, electromagnetic and mechanical apparatus and systems to activate or de-activate a device, automatically, or semi-automatically. Solenoid actuators are used in a variety of applications ranging from valve controls, electrical switch controls or contactors, or other electrical, electronic, hydraulic, pneumatic, mechanical systems and/or combinations thereof. Electric solenoid actuators are preferred from pneumatic and hydraulic actuators for many practical reasons. There are disadvantages with the use of electrical solenoids and this may include the limitation of motion as well as the limited force which is dictated by the strength of the electromagnet developed by the armature. The solenoid actuator of this disclosure operates on either AC or DC power supply depending on the coil and armature design which is dictated by the force required for specific applications and the type of power supply available.

20 Claims, 8 Drawing Sheets

EXPLODED VIEW OF SOLENOID ACTUATOR WITH AN INTEGRATED LOCKING & UNLOCKING MECHANISM

SOLENOID ACTUATOR WITH AN INTEGRATED LOCKING AND UNLOCKING MECHANISM

SEE-THROUGH VIEW OF SOLENOID ACTUATOR WITH AN INTEGRATED LOCKING AND UNLOCKING MECHANISM

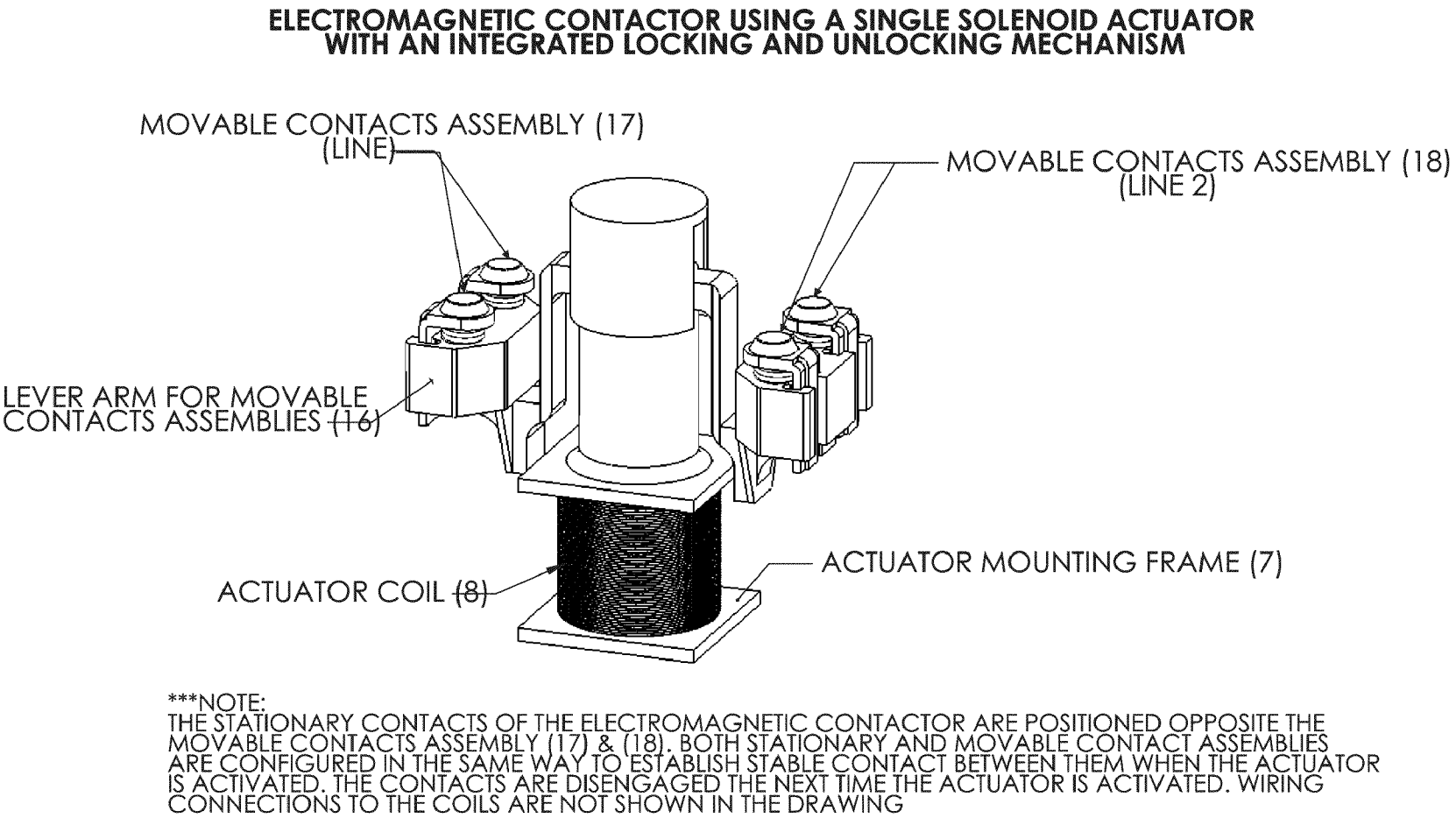

***NOTE:
THE STATIONARY CONTACTS OF THE ELECTROMAGNETIC CONTACTOR ARE POSITIONED OPPOSITE THE MOVABLE CONTACTS ASSEMBLY (17) & (18). BOTH STATIONARY AND MOVABLE CONTACT ASSEMBLIES ARE CONFIGURED IN THE SAME WAY TO ESTABLISH STABLE CONTACT BETWEEN THEM WHEN THE ACTUATOR IS ACTIVATED. THE CONTACTS ARE DISENGAGED THE NEXT TIME THE ACTUATOR IS ACTIVATED. WIRING CONNECTIONS TO THE COILS ARE NOT SHOWN IN THE DRAWING

FIG. 6

SEE-THROUGH VIEW OF THE ELECTROMAGNETIC CONTACTOR USING A SINGLE SOLENOID ACTUATOR WITH AN INTEGRATED LOCKING AND UNLOCKING MECHANISM

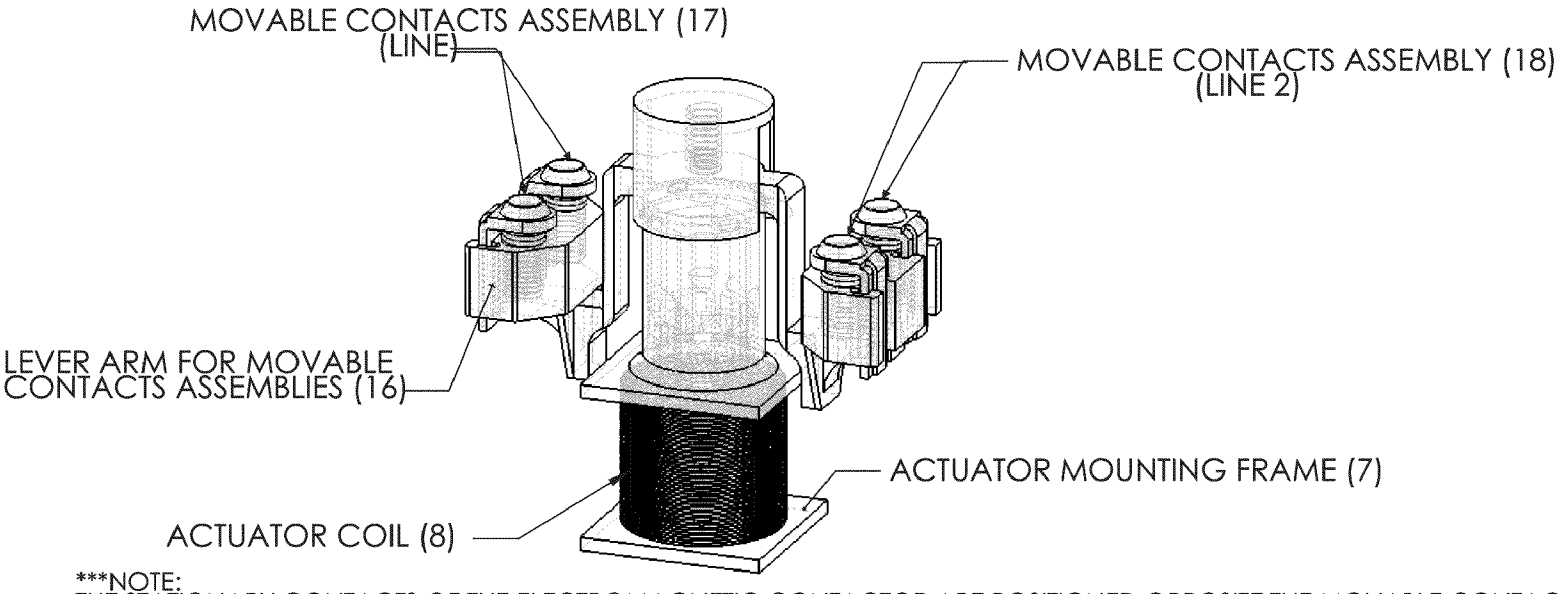

***NOTE:
THE STATIONARY CONTACTS OF THE ELECTROMAGNETIC CONTACTOR ARE POSITIONED OPPOSITE THE MOVABLE CONTACTS ASSEMBLY (17) & (18). BOTH STATIONARY AND MOVABLE CONTACT ASSEMBLIES ARE CONFIGURED IN THE SAME WAY TO ESTABLISH STABLE CONTACT BETWEEN THEM WHEN THE ACTUATOR IS ACTIVATED. THE CONTACTS ARE DISENGAGED THE NEXT TIME THE ACTUATOR IS ACTIVATED. WIRING CONNECTIONS TO THE COILS ARE NOT SHOWN IN THE DRAWING

FIG. 7

EXPLODED VIEW OF THE SOLENOID ACTUATOR WITH AN INTEGRATED LOCKING & UNLOCKING MECHANISM

SOLENOID ACTUATOR WITH AN INTEGRATED MECHANICAL LOCKING AND UNLOCKING FIXTURE

CROSS REFERENCE TO RELATED APPLICATIONS

This application is a Continuation-In-Part of, and claims priority from, U.S. application Ser. No. 12/642,737 filed on Dec. 18, 2009, which application further claimed priority from U.S. application Ser. No. 11/956,364, filed on Dec. 14, 2007.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

Field of the Invention

The present invention relates to a solenoid actuator with an integrated mechanical locking and unlocking fixture, which hereinafter will be referred to as the "solenoid assembly". The locking and unlocking mechanism is completely mechanical in nature without external actuators or manual release implements. The actuator is linear, single-coil, single-motion that is operated by either AC or DC power supply, depending on the coil design. The actuator could also be either a push or pull motion depending on the configuration required for the particular application, but for illustration purposes of this disclosure, the push motion is used. The locking and unlocking mechanism is integrated with the solenoid actuator, although with certain modifications and without departing from the principles and methods disclosed herein, it could be made an external part like an independent latch. The operation of the solenoid assembly is typical as every linear single-motion actuator where the shaft pushes out when the coil is energized and retracts to original rest position when the coil is de-energized. With the nature of solenoid operation where the shaft does not maintain an active or engaged position, to serve a latching feature, the locking and unlocking mechanism need to be engaged alternately in locked or unlocked positions by the same shaft motion when the actuator coil is energized.

There are currently available multiple types of solenoid actuators and although a variation of this disclosure by someone skilled in the art could cover other types, linear motion actuators is the main object of this disclosure. Such linear actuators could be tubular or open frame and other variations or modifications are typically available.

As the word implies, linear actuators move in a linear direction and the types available include but are not limited to:

Push (1-direction) with spring return to original position
Pull (1-direction) with spring return to original position
Push (1-direction) with mechanical latch that is released by secondary apparatus
Pull (1-direction) with mechanical latch that is released by secondary apparatus
Push (1-direction) with magnetic latch
Pull (1-direction) with magnetic latch
Push and Pull or reversible motion with and without latching
Push and Pull with double side magnetic latch Some solenoid actuators commercially available are reversible and this is accomplished by reversing polarity, if source is DC power, or by solid-state or electronic triggers that activates switch gates in positive or negative slopes of AC supply signal.

Most solenoid actuator industrial applications require a latching feature, and these are applicable to certain industries that includes automatic door and window locks, valve controllers, electrical switches and contactors. For electrical switch and electromagnetic contactor applications, currently available solenoid actuators either perform a switching operation with manual tripping or release mechanism, or where latch release feature is performed by a secondary solenoid actuator or other means.

Where solenoids are used with manual release mechanism, the additional components add to cost, with the disadvantage of lack of automation.

Where solenoid actuators require a latch release through a secondary solenoid actuator or a similar device, the additional cost of components and the requirement for additional mounting space become prohibitive to the application.

Where solenoids are required to maintain a locking position without external latching mechanism, a magnetic latch becomes an option. This type of latching however poses certain disadvantages. When used where temperature may rise, the magnetic force of the latching permanent magnets deteriorates which causes premature and unwanted latch release. In electromagnetic contactor applications, this deterioration in magnetic force causes chatters that could lead to unstable contacts, arcing and other electrical failures.

With limitations on the currently available solenoid actuators where latching is still a major obstacle directly attributed to application or cost, there are opportunities for improvement and development of new devices that provides practical and economic solutions, such as the object of this disclosure—a solenoid actuator with an integrated mechanical locking and unlocking fixture.

In the prior art, U.S. Pat. No. 7,298,236 discloses a circuit breaker electromagnetic tripping device utilizing two separate coils for tripping and reset. This is typically applicable to wiring devices where reset and tripping functions are actuated electronically. This type of electromagnetic contactor is used on Ground Fault Circuit Interrupter (GFCI), Arc Fault Circuit Interrupter, or any similar devices. Also, U.S. Pat. No. 3,819,282 disclosed a solenoid actuated pen mechanism limited to use on pens, and far more limited in novel features and scope when compared to the instant invention. This prior patent had the protract-retract mechanism controlled through a side projection which is different from this disclosure. Further, U.S. Pat. No. 3,679,317 disclosed a pen mechanism similar in function to the other aforementioned prior art, but said solenoid actuators were limited in the scope of their functionality when compared to the instant invention. When compared to the instant invention, the aforementioned prior art did not, and does not, anticipate or suggest, the novel elements and broader applicability in the instant invention.

BRIEF SUMMARY OF THE INVENTION

Electric Solenoid Actuators are used in a wide range of industries that require the combination of electrical, electromagnetic and mechanical apparatus and systems to activate or de-activate a device, automatically, or semi-automatically. Solenoid actuators are used in a variety of applications ranging from valve controls, electrical switch controls or contactors, or other electrical, electronic, hydraulic, pneumatic, mechanical systems and/or combinations thereof. Electric solenoid actuators are preferred from pneumatic and hydraulic actuators for practical reasons among which include numerous advantages such as their speed, size, simplicity, initial cost, maintenance (maintenance-free), ease of installation, and adaptability to wide range of applications. There are disadvantages with the use of electrical solenoids and this may include the limitation of motion as well as the limited force which is dictated by the strength of the electromagnet developed by the armature. The solenoid actuator of this disclosure operates on either AC or DC power supply depending on the coil and armature design which is dictated by the force required for specific applications and the type of power supply available.

There are currently available multiple types of solenoid actuators and although a variation of this disclosure by someone skilled in the art could cover other types, linear motion actuators is the main object of this disclosure. Such linear actuators could be tubular or open frame and other variations or modifications are typically available.

As the word implies, linear actuators move in a linear direction and the types available include but are not limited to:

Push (1-direction) with spring return to original position
Pull (1-direction) with spring return to original position
Push (1-direction) with mechanical latch that is released by secondary apparatus
Pull (1-direction) with mechanical latch that is released by secondary apparatus
Push (1-direction) with magnetic latch
Pull (1-direction) with magnetic latch
Push and Pull or reversible motion with and without latching
Push and Pull with double side magnetic latch Some solenoid actuators commercially available are reversible and this is accomplished by reversing polarity, if source is DC power, or by solid-state or electronic triggers that activates switch gates in positive or negative slopes of AC supply signal.

Most solenoid actuator industrial applications require a latching feature, and these are applicable to certain industries that includes automatic door and window locks, valve controllers, electrical switches and contactors. For electrical switch and electromagnetic contactor applications, currently available solenoid actuators either perform a switching operation with manual tripping or release mechanism, or where latch release feature is performed by a secondary solenoid actuator or other means.

Where solenoids are used with manual release mechanism, the additional components add to cost, with the disadvantage of lack of automation.

Where solenoid actuators require a latch release through a secondary solenoid actuator or a similar device, the additional cost of components and the requirement for additional mounting space become prohibitive to the application.

Where solenoids are required to maintain a locking position without external latching mechanism, a magnetic latch becomes an option. This type of latching however poses certain disadvantages. When used where temperature may rise, the magnetic force of the latching permanent magnets deteriorates which causes premature and unwanted latch release. In electromagnetic contactor applications, this deterioration in magnetic force causes chatters that could lead to unstable contacts, arcing and other electrical failures.

With limitations on the currently available solenoid actuators where latching is still a major obstacle directly attributed to application or cost, there are opportunities for improvement and development of new devices that provides practical and economic solutions, which is the object of the instant invention; i.e. a novel solenoid actuator as more particularly described herein and all related methods for operation of said novel solenoid actuator in its various embodiments with an integrated mechanical locking and unlocking fixture as set forth below.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

In the drawings:

FIG. 6 is a perspective view of the electromagnetic contactor.

FIG. 7 is a transparent perspective view of the electromagnetic contactor.

DETAILED DESCRIPTION OF THE EMBODIMENTS

Figure 1:
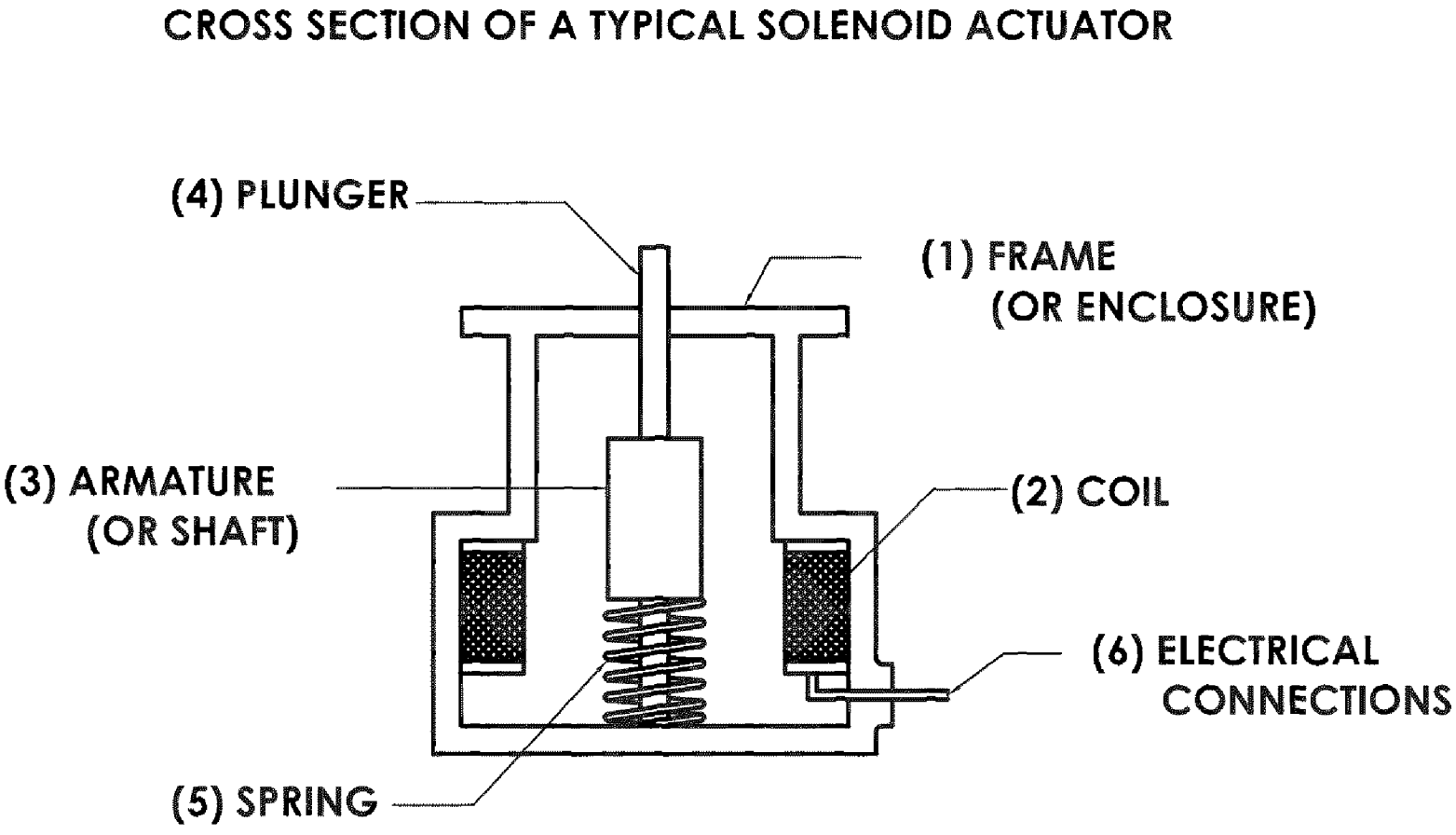
FIG. 1 is a cross sectional view of the preferred embodiment.
Figure 2:
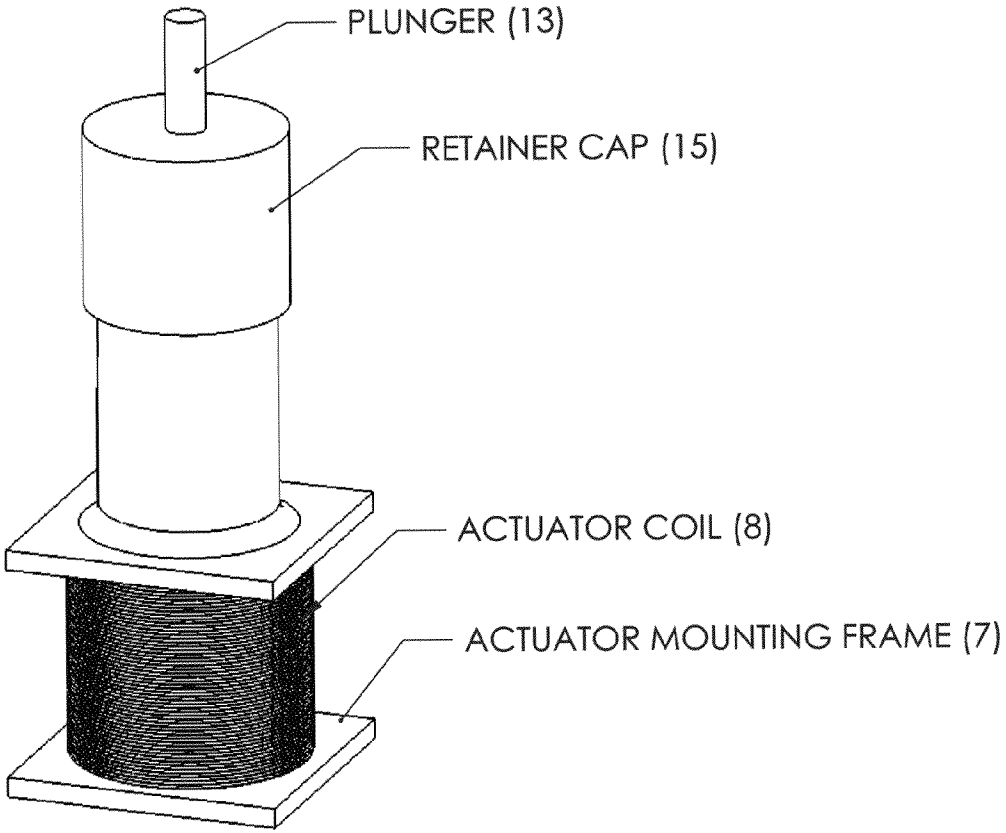
FIG. 2 is a perspective view of the preferred embodiment.
Figure 3:
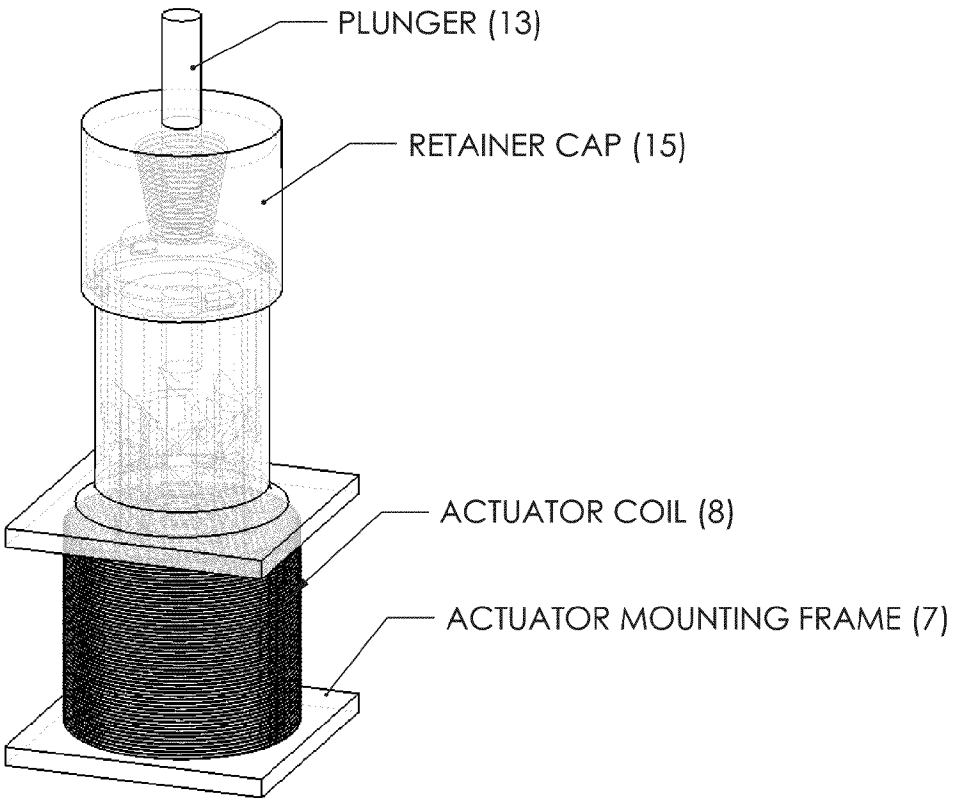
FIG. 3 is a transparent perspective view of the preferred embodiment.
Figure 4:
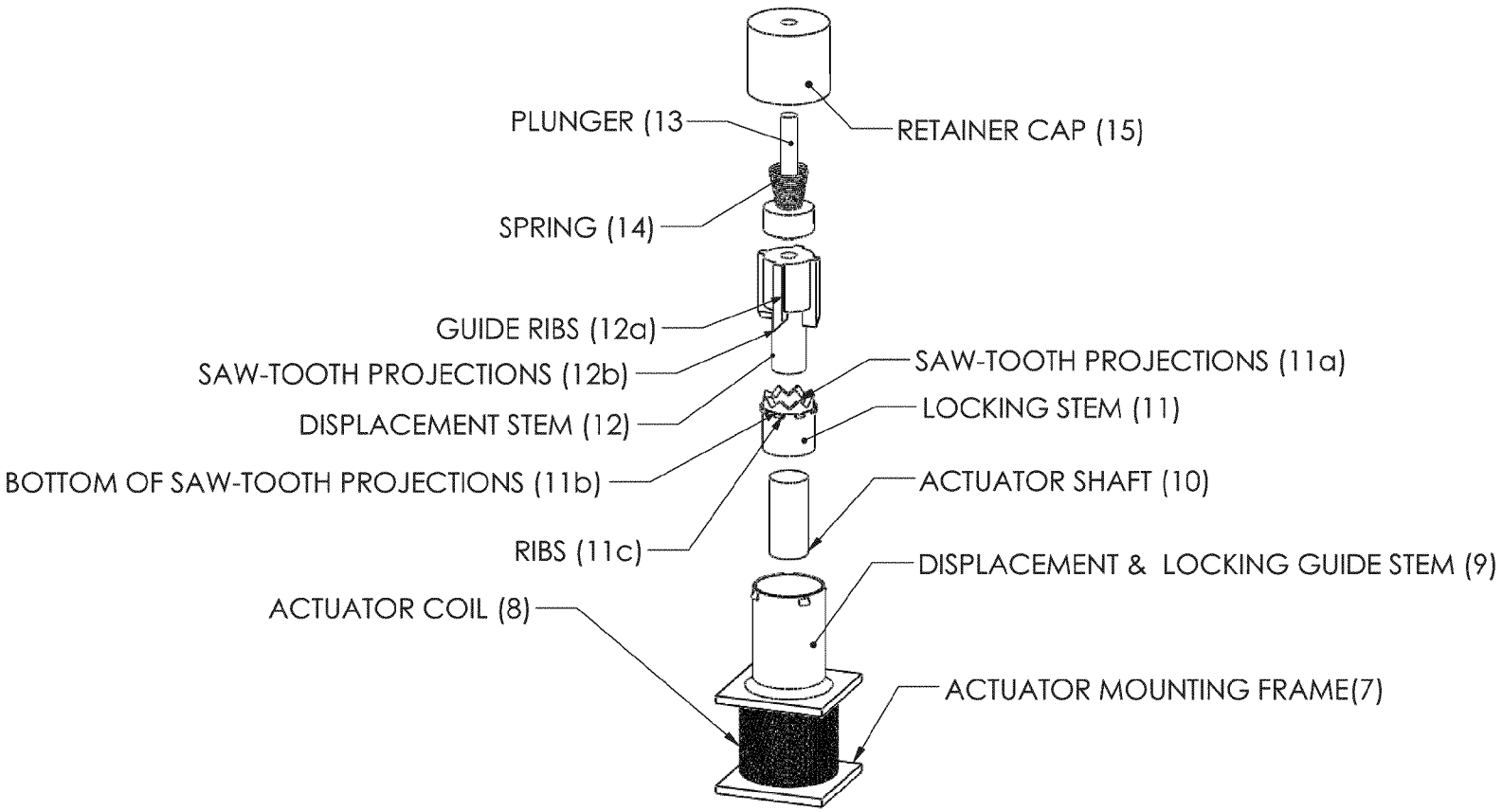
FIG. 4 is an exploded view of the preferred embodiment.

This disclosure is for a solenoid actuator with an integrated mechanical locking and unlocking fixture, which hereinafter will be referred to as the "solenoid assembly".

The locking and unlocking mechanism is completely mechanical in nature without external actuators or manual release implements. The actuator is linear, single-coil, single-motion that is operated by either AC or DC power supply, depending on the coil design. The actuator could also be either a push or pull motion depending on the configuration required for the particular application, but for illustration purposes of this disclosure, the push motion is used. The locking and unlocking mechanism is integrated with the solenoid actuator, although with certain modifications and without departing from the principles and methods disclosed herein, it could be made an external part like an independent latch. The operation of the solenoid assembly is typical as every linear single-motion actuator where the shaft pushes out when the coil is energized and retracts to original rest position when the coil is de-energized. With the nature of solenoid operation where the shaft does not maintain an active or engaged position, to serve a latching feature, the locking and unlocking mechanism need to be engaged alternately in locked or unlocked positions by the same shaft motion when the actuator coil is energized.

There are certain mechanisms that have been used in another industry with unrelated applications that could be improved and adopted for use with solenoids to attain the objectives of this disclosure. Such similar mechanisms had been used for several decades in the pen industry, specifically with retractable pens. Patents for retractable pen mechanisms have been issued in the past now expired and are considered public knowledge. Said expired patents disclosed similar mechanism for use on pens only and not for any other applications. Although similar principle is used, this disclosure is different in the way the mechanism is used and applied, as well as the improvements made to be adoptable for use with solenoid actuators.

In prior arts, the mechanism was only intended for pens which are a light duty application where the locking and unlocking motion is attained by pushing a stem manually. This disclosure uses an electrical solenoid actuator to push the stem instead of doing it manually in the case of a pen and in the process engages the solenoid assembly to either a locked or unlocked position (or latched and unlatched in other terms). Prior arts only disclosed a similar mechanism for use on pens and not for any other applications, as well as the mechanism being an integral part of the pen.

This disclosure is for solenoid actuators with integral mechanical locking and unlocking mechanism which is not intended for handheld pens. The solenoid assembly can be used in applications such as electromagnetic contactors, relays, valve controllers, and other applications that require a solenoid actuator with locking and unlocking mechanism, such as that of this disclosure.

The actuator mounting frame with the displacement and locking guide stem, locking stem, displacement stem, retainer cap, lever arm for movable contact assemblies are typically molded from nylon, acrylonitrile-butadiene-styrene (ABS), polycarbonate (PC), or any other polymeric materials, all of which are of type and grade that qualifies to the test requirements of the electromagnetic contactor's particular application. These parts may alternatively be produced from metallic alloys of type and grade that qualifies to the test requirements of the electromagnetic contactor's particular application.

FIG. 1 shows a typical solenoid actuator which mainly consists of a bobbin (1) or an actuator mounting frame, coil (2), armature (3), stem or shaft (4), spring (5) and Electrical Connections (6) to external power source which could either be AC or DC, depending on the design of the coil. The spring rests on the armature to force it outward (or pull inward depending on the solenoid design). The armature moves inside the coil in linear direction and transmits its motion through the shaft.

FIGS. 2, 3, 4, & 5 discloses a solenoid actuator with integrated locking and unlocking mechanism. This solenoid assembly consists of a single actuator coil (8) mounted on its frame (7) with a displacement and locking guide stem (9); actuator shaft (10) which is actually the armature, locking stem (11), displacement stem (12), plunger (13); recoil spring (14); retainer cap (15). Inside guide stem (9) are slots and ribs that guide the movement of displacement stem (12) and locking stem (11). The ribs of guide stem (9) have double saw-tooth shaped projections (9*a*) & (9*b*). (9*a*) are the major saw-tooth projections which serves as the upper position lock, whereas (9*b*) are the minor saw-tooth projections that slopes to the slots (9*c*). The saw-tooth shaped projections (9*a*) and (9*b*) are sloped with the same angle but of opposite orientation in the assembly with the saw-tooth projections (12*b*). Locking stem (11) is equipped with ribs on the side that moves along the slots (9*c*) on guide stem (9) to keep it firmly in position. The top of locking stem (11) has saw-tooth shaped projections that locks with projections (12*b*). For every solenoid actuation, the wedging actions between the sawtooth-shaped projections of stems (9), (11) & (12) causes the displacement stem (12) to turn incrementally which positions the projections (12*b*) to either the upper lock (9*d*) or on the (9*c*) slots where they rest on top of guide ribs (11*c*) at the lower lock (9*e*) position. The upper lock (9*d*) and lower lock (9*e*) positions respectively correspond to the plunger locked and unlocked positions. Recoil spring (14) pushes the plunger (13) downward as cushion on both locked and unlocked positions, as well as to support proper positioning and integrity of the assembly. Locking stem (11) may optionally be coupled with actuator shaft (10).

One position of the locking and unlocking mechanism is such that the projections (12*b*) are engaged with (11*b*) and guide ribs (11*c*) are resting on the lower lock position (9*e*) of guide stem (9). This position corresponds to the unlocked position of the plunger.

The other position of the locking and unlocking fixture is such that the projections (12*b*) are engaged with the upper lock (9*d*) positions on the saw-tooth projections of stem (9). This position corresponds to the locked position of the plunger.

On locked position, projections (12*b*) are engaged with the saw-tooth projections (11*b*) almost halfway down from the top and restrained in this position by the ribs (11*c*) positioned along the slots (9*c*).

When actuator coil (8) is activated, shaft (10) pushes stems (11) & (12) upward through and beyond the slots (9*c*) of guide stem (9). At this point, guide ribs (12*a*) gets out of the slots (9*c*) and projections (12*b*) continues its slide down to the bottom of the slope of the projections (11*b*) causing a side shift motion that positions the projections (12*b*) towards the major saw-tooth projections (9*a*) slightly below the top. At this position, by the pressure imposed by recoil spring (14), the projections (12*b*) have nowhere to go but continuously slide down the slope towards the upper lock position (9*d*). This position corresponds to the locked position of the plunger.

The next time the actuator coil is activated, shaft (10) pushes stems (11) & (12) upward through and beyond the slots of guide stem (9). At this point, guide ribs (12*a*) gets out of the slots (9*c*) and the projections (12*b*) continues its slide down to the bottom of the slope of the projections (11*b*) thereby making a side shift motion that repositions the projections (12*b*) towards the minor saw-tooth projections (9*b*) slightly below the top. At this position, by the pressure imposed by recoil spring (14), the projections (12*b*) have nowhere to go but continuously slide down the slope getting inside the slots (9*c*) of the guide stem until the guide ribs (11*c*) rests on the lower lock position (9*e*). This position corresponds to the unlocked position of the plunger.

The orientation of the saw-tooth projections (9*a*), (9*b*) & (12*b*) directs the incremental motion of displacement stem (12*b*) either clockwise or counter-clockwise. The depth of slots (9*c*) and the slopes or angles in reference to x-axis drawn from the bottom of each of the saw-tooth projections (9*a*), (9*b*), (11*a*) & (12*b*) may be varied according to the displacement desired which is also a factor of the diameter of stem (11) and the pitch of the saw-tooth projections (11*b*).

Figure 5:
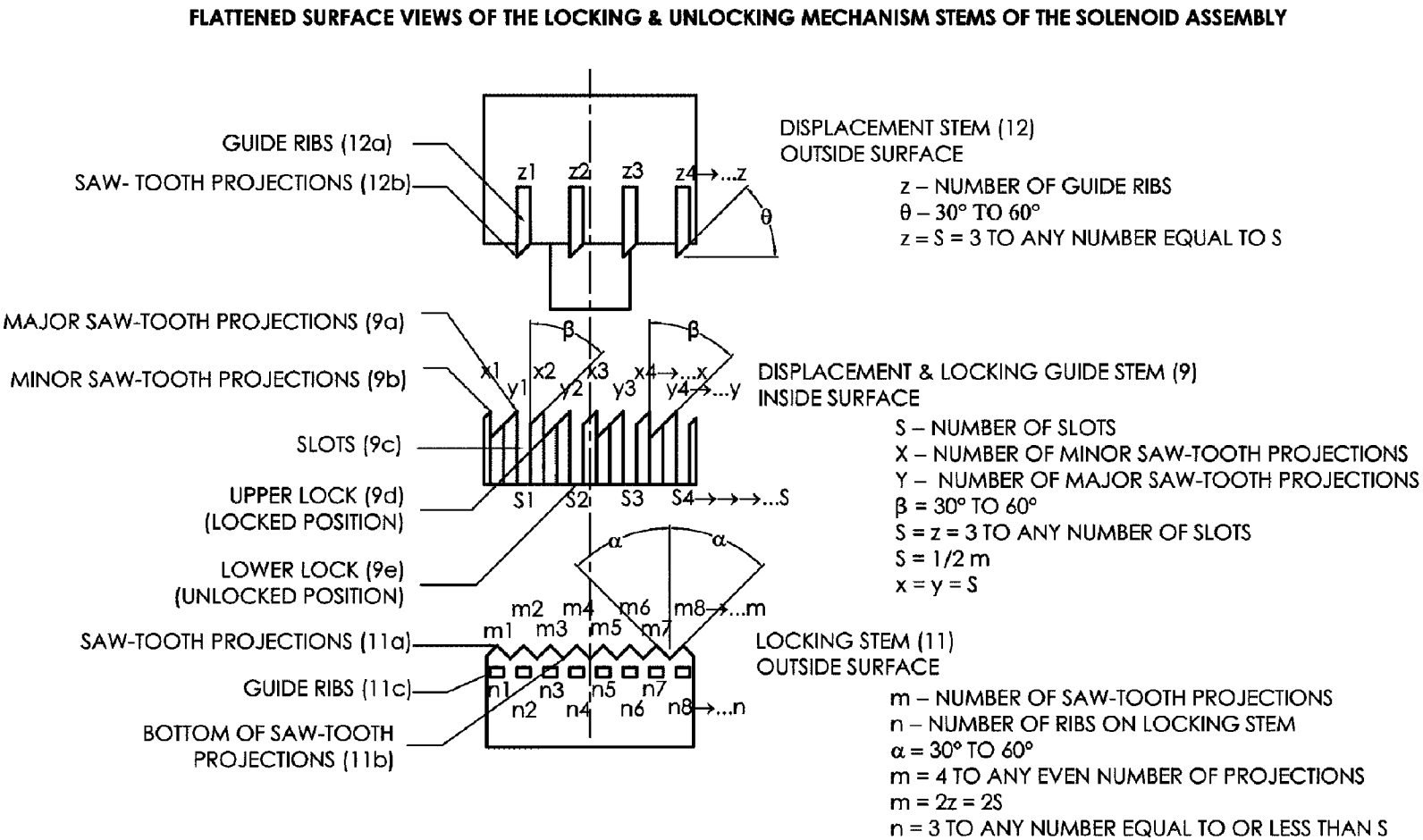
FIG. 5 is a flattened surface view of the locking and unlocking mechanism of the preferred embodiment.

FIG. 5 discloses the mathematical relationships between the 3 main components of the locking and unlocking mechanism as an integral part of the solenoid assembly. As the solenoid assembly could be used in a wide range of applications, these relationships are important in the design of the actual mechanism taking into consideration the number of possible combinations of such variables such as the number of slots, saw-tooth projections, guide ribs, the angles of the saw-tooth projections, the length of slots and other parameters—all these being dictated by the size of the assembly and the diameter of the shaft and stems, the length of stroke or linear displacement of the plunger between locked and unlocked and specially the force required to engage the locking and unlocking mechanism.

The retainer cap (15) could be modified according to actual application and could be secured with the displacement and locking guide stem (9) in number of ways as required for particular applications, threaded or by other mechanical means.

The end of plunger (13) could be configured or adopted to the actual applications.

The actuator mounting frame could be made with open frame or enclosed as actually required for specific applications, and designed to meet mounting requirements.

Figure 8:
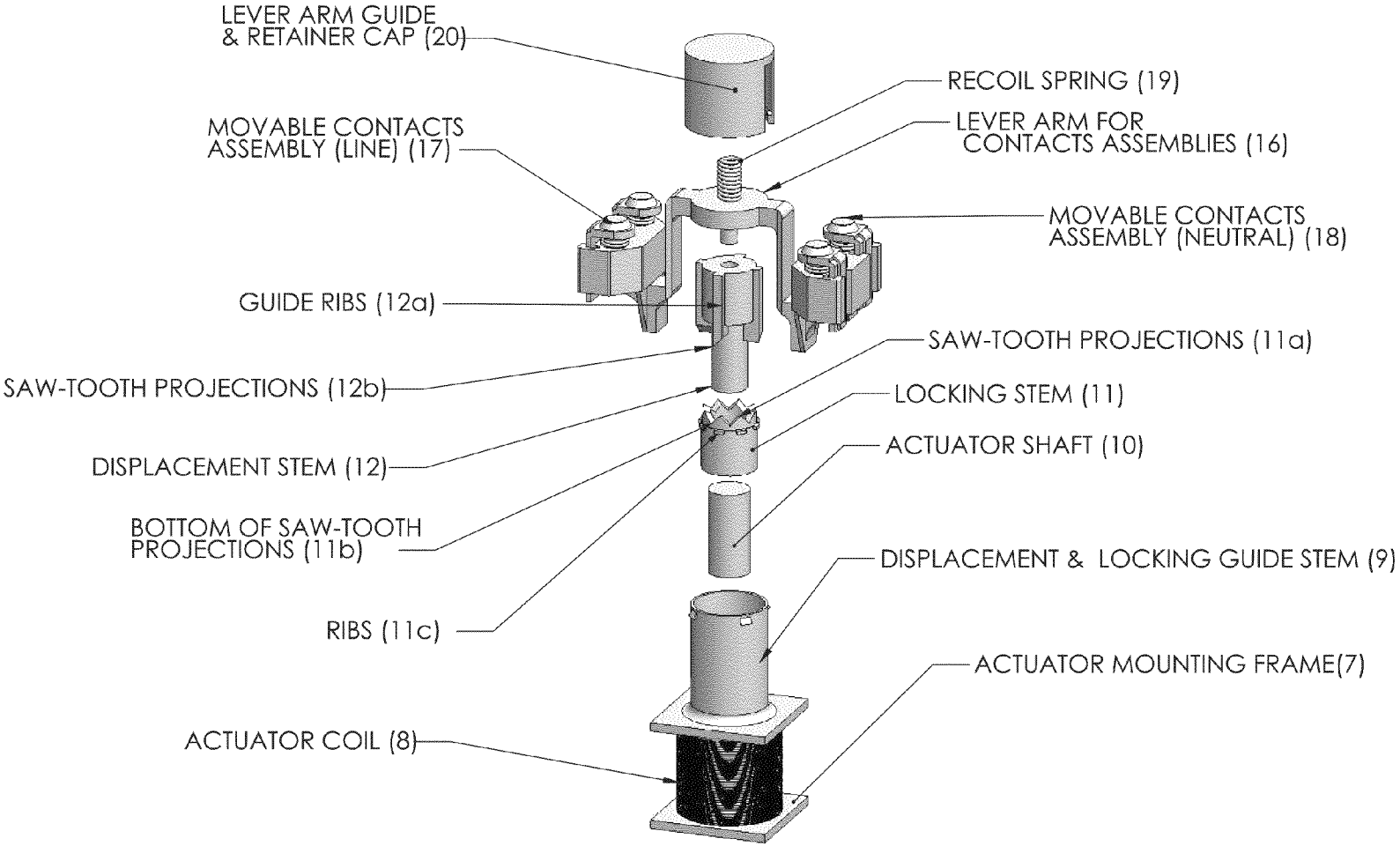
FIG. 8 is an exploded view of the preferred embodiment with integrated locking and unlocking mechanism.

FIGS. 6, 7, 8 discloses the solenoid actuator with integrated locking and unlocking mechanism as used on an electromagnetic contactor. Here, the locking and unlocking mechanism corresponds to the engaged and disengaged positions of the contactor. This is an electromagnetic contactor which could be operated on either DC or AC power supply using a linear single-motion, single-coil, solenoid actuator for its trip and reset functions. Either push or pull motion actuator could be used with this contactor depending on the configuration of the lever arm, and the orientation between movable contacts and the stationary contacts assembly.

The operation of this electromagnetic assembly is as explained for the solenoid assembly, with exceptions that the movable contacts assembly is added in place of the plunger; and the retainer cap revised to accommodate the new fixture. The upper (9*d*) and lower lock (9*e*) positions respectively correspond to the electromagnetic contactor RESET and TRIP positions (also termed as engaged and disengaged positions). Recoil spring (14) pushes the assembly downwards to provide cushion for proper contact pressure between movable and stationary contacts, as well as to support proper positioning and integrity of the assembly. Locking stem (11) may optionally be coupled with actuator shaft (10) which is actually the armature.

In reference to FIG. 5, one position of the locking and unlocking mechanism is such that the projections (12*b*) are engaged with (11*b*) and guide ribs (11*c*) are resting on the lower lock position (9*e*) of guide stem (9). This position corresponds to the TRIP (or DISENGAGED) position of the electromagnetic contactor wherein the movable contact assemblies (17) & (18) are disengaged with the stationary contact assemblies positioned directly opposite them.

In reference to FIG. 5, the other position of the locking and unlocking fixture is such that the projections (12*b*) are engaged with the upper lock (9*d*) positions on the saw-tooth projections of stem (9). This position corresponds to the RESET (or DISENGAGED) position of the electromagnetic contactor wherein the movable contact assemblies (17) & (18) are engaged with the stationary contact assemblies positioned directly opposite them.

On RESET position, projections (12*b*) are engaged with the saw-tooth projections (11*b*) almost halfway down from the top and restrained in this position by the ribs (11*c*) moving along the slots (9*c*).

When actuator coil (8) is activated, shaft (10) pushes stems (11) & (12) upward through and beyond the slots (9*c*) of guide stem (9). At this point, guide ribs (12*a*) get out of the slots (9*c*) and projections (12*b*) continues its slide down to the bottom of the slope of the projections (11*b*) thereby causing a side shift motion that positions the projections (12*b*) towards the major saw-tooth projections (9*a*) slightly below the top. At this position, the projections (12*b*) have nowhere to go but continuously slide down the slope towards the upper lock position (9*d*). This position corresponds to the RESET position of the electromagnetic contactor wherein the movable contacts assemblies (17) & (18) are engaged with the stationary contact assemblies of the AFCI.

The next time the actuator coil is activated, shaft (10) pushes stems (11) & (12) upward through and beyond the slots (9*c*) of guide stem (9). At this point, guide ribs (12*a*) gets out of the slots (9*c*) and the projections (12*b*) continues its slide down to the bottom of the slope of the projections (11*b*) thereby making a side shift motion that positions the projections (12*b*) towards the minor saw-tooth projections (9*b*) slightly below the top. At this position, by the pressure imposed by recoil spring (19), the projections (12*b*) have nowhere to go but continuously slide down the slope getting inside the slots (9*c*) of the guide stem until the guide ribs (11*c*) rests on the lower lock position (9*e*). This position corresponds to the TRIP position of the electromagnetic contactor wherein the movable contact assemblies (17) & (18) are disengaged with the stationary contact assemblies of the AFCI.

The orientation of the saw-tooth projections (9*a*), (9*b*) & (12*b*) directs the incremental motion of displacement stem (12) either clockwise or counter-clockwise, depending on the teeth orientation. The depth of slots (9*c*) and the slopes or angles in reference to x-axis drawn from the bottom of each of the saw-tooth projections (9*a*), (9*b*), (11*a*) & (11*b*) may be varied according to the displacement desired which is also a factor of the diameter of stem (11) and the pitch of the saw-tooth projections (11*b*).

Although this alternative electromagnetic contactor is disclosed for a 2-pole application, without any limitations and using the same methods or techniques of this disclosure, the contacts and lever assemblies may be configured for use on contactors for 1-pole and any number of poles.

This electromagnetic contactor is used to illustrate an application of the principles, techniques and methods in this disclosure which could be adopted for use in any other applications and industries beyond the scope of this disclosure.

The retainer cap (20) could be modified according to actual application and could be secured with the displacement and locking guide stem (9) in number of ways as required for particular applications.

The actuator mounting frame could be made with open frame or enclosed, and with mounting fixture as actually required for specific applications.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A solenoid actuated assembly apparatus, said apparatus comprising: a linear motion, single-coil solenoid actuator, capable of operation on either an Alternating Current or Direct Current power supply, said apparatus further comprising an integrated locking and unlocking mechanism, said solenoid actuated assembly having a single actuator coil mounted on its frame and having a displacement and locking guide stem, having an actuator shaft being the armature, having a locking stem, having a displacement stem, having a plunger, having a recoil spring, having a retainer cap, inside said displacement and locking guide stem, are slots and ribs that guide the movement of said displacement stem and said locking stem, the ribs of said displacement and locking guide stem have double saw-tooth shaped projections, where the major saw-tooth projections serve as the upper position lock, whereas the minor saw-tooth projections slope to the slots thereon, said saw-tooth shaped projections are sloped with the same angle but of opposite orientation in the assembly with the saw-tooth projections of the displacement stem, said locking stem thereon is equipped with ribs on the side that move along the slots on the displacement and locking guide stem to keep it firmly in position, the top of said locking stem having saw tooth projections that lock with saw-tooth projections of said displacement stem, whereby for every solenoid actuation, the wedging actions between the saw-tooth shaped projections of the stems cause the displacement stem to turn incrementally thereby positioning the saw-tooth projections to either the upper lock or on the slots where they rest on top of the guide ribs of the locking stem at the lower lock position, the upper and lower lock positions respectively corresponding to the plunger locked and unlocked positions, further having a recoil spring to push the plunger downward to cushion on both locked and unlocked position, as well as to support positioning and integrity of the assembly, and said mechanism mechanically latching, and thereby locking, the solenoid assembly at the end of the solenoid shaft's allowable travel with the single coil solenoid then being in the de-energized state at the end of the solenoid shaft's completed travel, said mechanism mechanically unlatching, and thereby unlocking, the solenoid assembly at the end of the solenoid shaft's allowable travel with the single coil solenoid then being in the de-energized state at the end of the solenoid shaft's completed travel, thereby eliminating the need of permanent magnets to hold said latching mechanism, and said apparatus operating as a self-latching and self-unlatching device by the solenoid actuator repeating the same linear motion, said apparatus' integrated locking and unlocking mechanism being completely mechanical in nature, without need of secondary actuator or external release fixture.

2. The apparatus of claim 1, wherein said apparatus is used on electromagnetic contactors, relays, valve controllers, and other applications that require a solenoid actuator with said locking and unlocking mechanism.

3. The apparatus of claim 1, wherein said apparatus is applied to electrical switches, electromagnetic contactors or circuit breakers, thereby said apparatus eliminating the need of manual reset or switching mechanism, devices, or secondary actuators to engage contacts.

4. The apparatus of claim 1 wherein said apparatus latching and unlatching with the same motion is required by coupling or adopting the plunger with fixtures specific to particular applications.

5. The apparatus of claim 1 wherein said apparatus repeats said linear motion and said locking and unlocking mechanism further comprises saw-tooth projections on the stems generating an incremental clockwise or counter-clockwise motion that sets the locking and unlocking mechanism to a lower or an upper lock position corresponding respectively to an unlocked or locked position.

6. The apparatus of claim 1 wherein said apparatus further having an actuator mounting frame with displacement and locking guide stem, coil, actuator shaft or the armature, and the locking and unlocking mechanism with associated fixtures.

7. The apparatus of claim 1 wherein said apparatus' shaft is not mechanically coupled with the locking and unlocking mechanism.

8. The apparatus of claim 1, wherein the frame of said apparatus is configured as open, tubular or enclosed.

9. The apparatus of claim 1, wherein said apparatus moves only in single-motion, in a push or pull direction.

10. The apparatus of claim 1, wherein said apparatus' shaft is mechanically coupled with the locking and unlocking mechanism.

11. The apparatus of claim 10, wherein said apparatus' displacement and locking stem guide being integral part of the actuator frame, and is a separate part.

12. The apparatus of claim 11, wherein said apparatus' actuator frame, the displacement and locking guide stem, locking stem, displacement stem, retainer cap, being molded from nylon, acrylonitrile-butadiene-styrene, polycarbonate, or any other polymeric materials.

13. The apparatus of claim 12, wherein said apparatus is modified to suit the mechanical retention requirements of the plunger, the method of mounting with the locking and displacement guide stem, the spring mounting requirements, and other fixtures.

14. The apparatus of claim 1, wherein said apparatus' locking and unlocking mechanism is in either clockwise or counter-clockwise incremental motion depending on the orientation of said apparatus' saw-tooth projections of its displacement and locking guide stem.

15. The apparatus of claim 1, wherein said apparatus' locking and unlocking mechanism's operation is made possible by adapting the plunger and the depth of the slots on the displacement and locking guide stem to the desired position to cause the device to make an incremental circular movement, either clockwise or counter-clockwise.

16. The apparatus of claim 1, wherein when said apparatus is applied to an electromagnetic contactor, the locked and unlocked positions correspond respectively to the reset or engaged position and the trip or disengaged position.

17. The apparatus of claim 16, wherein said electromagnetic contactor comprises a single-coil electrical solenoid actuator, a mechanical locking or reset and unlocking or trip mechanism, contacts lever arm with movable contacts assembly, recoil spring, and a lever arm guide and retainer cap.

18. The apparatus of claim 17, wherein the locked position on said apparatus is when it is locked on the upper lock position, and unlocked position is when it is locked on the lower lock position.

19. The apparatus of claim 18, wherein said electromagnetic contactor is a single-coil actuated device with test and reset mechanism that is only intended as a switching device.

20. A method for operation of a solenoid actuated assembly, said method comprising:

Having an electrically actuated solenoid actuated assembly, said assembly having a linear motion, single-coil solenoid actuator, being capable of operation on either an Alternating Current or Direct Current power supply, said solenoid actuated assembly having a single actuator coil mounted on its frame and having a displacement and locking guide stem, having an actuator shaft being the armature, having a locking stem, having a displacement stem, having a plunger, having a recoil spring, having a retainer cap, inside said displacement and locking guide stem, are slots and ribs that guide the movement of said displacement stem and said locking stem, the ribs of said displacement and locking guide stem have double saw-tooth shaped projections, where the major saw-tooth projections serve as the upper position lock, whereas the minor saw-tooth projections slope to the slots thereon, said saw-tooth shaped projections are sloped with the same angle but of opposite orientation in the assembly with the saw-tooth projections of the displacement stem, said locking stem thereon is equipped with ribs on the side that move along the slots on the displacement and locking guide stem to keep it firmly in position, the top of said locking stem having saw tooth projections that lock with saw-tooth projections of said displacement stem, whereby for every solenoid actuation, the wedging actions between the saw-tooth tooth shaped projections of the stems cause the displacement stem to turn incrementally thereby positioning the saw-tooth projections to either the upper lock or on the slots where they rest on top of the guide ribs of the locking stem at the lower lock position, the upper and lower lock positions respectively corresponding to the plunger locked and unlocked positions, further having a recoil spring to push the plunger downward to cushion on both locked and unlocked positions, as well as to support positioning and integrity of the assembly, and said mechanism mechanically latching, and thereby locking, the solenoid assembly at the end of the solenoid shaft's allowable travel with the single coil solenoid then being in the de-energized state at the end of the solenoid shaft's completed travel, said mechanism mechanically unlatching, and thereby unlocking, the solenoid assembly at the end of the solenoid shaft's allowable travel with the single coil solenoid then being in the de-energized state at the end of the solenoid shaft's completed travel, said assembly further having an integrated locking and unlocking mechanism thereby eliminating the need of permanent magnets to hold latches, and said assembly operating as a self-latching and self-unlatching device by the actuator repeating the same linear motion, said assembly's integrated locking and unlocking mechanism being completely mechanical in nature, without need of secondary actuator or external release fixture.

* * * * *